US007883312B2

(12) United States Patent
Eguchi et al.

(10) Patent No.: US 7,883,312 B2
(45) Date of Patent: Feb. 8, 2011

(54) CENTRIFUGAL BLOWER

(75) Inventors: Tsuyoshi Eguchi, Takasago (JP); Atsushi Suzuki, Kiyosu (JP); Tetsuo Tominaga, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 671 days.

(21) Appl. No.: 11/663,974

(22) PCT Filed: Mar. 29, 2006

(86) PCT No.: PCT/JP2006/306491

§ 371 (c)(1),
(2), (4) Date: Mar. 28, 2007

(87) PCT Pub. No.: WO2006/106744

PCT Pub. Date: Oct. 12, 2006

(65) Prior Publication Data

US 2008/0279681 A1 Nov. 13, 2008

(30) Foreign Application Priority Data

Mar. 31, 2005 (JP) ..... 2005-102079
Dec. 9, 2005 (JP) ..... 2005-356307

(51) Int. Cl.
*F04D 29/28* (2006.01)
*F04D 29/44* (2006.01)

(52) U.S. Cl. ..... 415/119; 415/205; 415/206; 415/211.2

(58) Field of Classification Search ..... 415/119, 415/205, 206, 211.2, 189
See application file for complete search history.

(56) References Cited

U.S. PATENT DOCUMENTS 4,838,760 A * 6/1989 Brackett ..... 416/93 R (Continued)

FOREIGN PATENT DOCUMENTS

EP 1 386 764 A2 2/2004

(Continued)

*Primary Examiner*—Edward Look
*Assistant Examiner*—Jesse Prager
(74) *Attorney, Agent, or Firm*—Birch, Stewart, Kolasch & Birch, LLP

(57) ABSTRACT

A centrifugal blower has: an impeller; and a casing that houses the impeller. The impeller has: a bottom plate; blades provided on a same circumference of the bottom plate; and a shroud that has the blades interposed between it and the bottom plate, disposed concentric with the bottom plate, and connects end sections of the respective blades. The shroud has: an inclined section that comes closer to the bottom plate moving from a radial direction inside to a radial direction outside; and a shroud side barrier that rises from a position on the radial direction outside of the inclined section towards a side opposite to the bottom plate. The casing has a bell-mouth that opens from a radial direction inside of the shroud to a radial direction outside, and a casing side barrier that projects to an area between the inner periphery of the shroud and the shroud side barrier.

11 Claims, 7 Drawing Sheets

U.S. PATENT DOCUMENTS

| | | | | |
|---|---|---|---|---|
| 5,511,939 | A * | 4/1996 | Tokunaga et al. | 415/206 |
| 5,601,400 | A * | 2/1997 | Kondo et al. | 415/119 |
| 5,813,831 | A * | 9/1998 | Matsunaga et al. | 415/173.6 |
| 5,915,921 | A * | 6/1999 | Sabini | 415/173.1 |
| 6,755,615 | B2 | 6/2004 | Chapman | |
| 2002/0004008 | A1* | 1/2002 | Miyata | 415/206 |
| 2002/0025253 | A1* | 2/2002 | Ozeki et al. | 415/206 |

FOREIGN PATENT DOCUMENTS

| | | | |
|---|---|---|---|
| JP | 64-47999 | U | 3/1989 |
| JP | 7-27097 | A | 1/1995 |
| JP | 10-54388 | A | 2/1998 |
| JP | 2940751 | B2 | 6/1999 |
| JP | 2000-291590 | A | 10/2000 |
| JP | 2002-235697 | A | 8/2002 |
| JP | 3404858 | B2 | 3/2003 |
| JP | 3438269 | B2 | 6/2003 |
| JP | 3489161 | B2 | 11/2003 |
| JP | 2004-68644 | A | 3/2004 |
| JP | 2004-515677 | A | 5/2004 |
| WO | WO-02/45862 | A2 | 6/2002 |

* cited by examiner

CENTRIFUGAL BLOWER

BACKGROUND OF THE INVENTION

1. Field of the Invention

The present invention relates to a centrifugal blower.

2. Description of the Related Art

A centrifugal blower has an impeller, a casing that houses this impeller and forms a spiral flow passage around the radial direction outside of the impeller, and a driving device that rotates the impeller about the axis thereof. In the centrifugal blower the impeller is rotated by the driving device to impart a centrifugal force to the gas that has been taken into the casing and force feeding it into the flow passage. Air is supplied from the impeller to the spiral flow passage sequentially from a start point to a downstream side. Therefore, the internal pressure at the start point of the spiral flow passage is lowest and the internal pressure becomes higher close to the downstream side. The portion of the spiral flow passage one circle from the start point is adjacent to the start point, where the internal pressure is lowest. As a result, the internal pressure of the spiral flow passage in the vicinity of a border section one circle from the start point, (hereinafter referred to as the "nose section"), is close to that at the start point.

Such a centrifugal blower is used as an air blower for a vehicle air conditioning apparatus as in the multi-vane air blower disclosed in Patent Document 1 mentioned later for example.

The impeller has: a disk shaped bottom plate that is rotated about its axis by a driving device; a large number of blades provided projecting in the axial direction on the same circumference of this bottom plate; and a substantially annular plate shape shroud disposed concentric with the bottom plate, and having the blades interposed between it and the bottom plate, and being joined to the end part of each blade.

In the casing, there is provided a bell-mouth that opposes the area on the radially inside of the shroud to serve as an air intake. The air that has been supplied to the bell-mouth is imparted with a centrifugal force by rotating the impeller, and then force fed into the flow passage.

Patent Document 1:

Japanese Unexamined Patent Application, Publication, No. Hei 7-27097

SUMMARY OF THE INVENTION

In a centrifugal blower, in order to allow rotation of an impeller, a gap is provided between a shroud of the impeller and an inner plane of the casing (back side of a bell-mouth). As a result, some of the air that has been force fed into the flow passage flows back from this gap into an area on the radially inside of the blades of the impeller (hereinafter, this flow is referred to as "backflow"). Since this backflow interferes with the flow of the air that has been taken into the casing from the bell-mouth (hereinafter, this flow is referred to as the "main flow"), noise is generated and operation of the centrifugal blower becomes unstable.

In a multi-vane air blower disclosed in Patent Document 1: a shroud is formed in a substantially arc-shaped sectional shape along a flow of air that inflows and changes direction, between the air intake and the blades, from an axial direction of a centrifugal multi-vane fan (impeller) to a fan radially outward direction; the sectional shape of an inner wall in the vicinity of a bell-mouth of a case (casing) is formed to follow the sectional shape of the shroud via a minute gap, a concave section in a ring shape when seen from the blade side being formed in the bell-mouth; and a ring shape protrusion that extends into the ring shaped concave section being formed on a radial direction end of the shroud; and prevention of backflow is achieved thereby. However, even by employing such a configuration a significant backflow prevention effect could not be obtained.

Here, fan characteristic graphs for blowers (graphs in which the horizontal axis represents flow rate and the vertical axis represents blowing pressure) show an overall downward curved line, and this does not apply only to centrifugal blowers. However, in these graphs, the line is not always downward in all areas, and it is locally horizontal or upward (for example, in the small airflow area). When operating a blower in such an area, the impeller stalls, airflow within the casing becomes unstable, and noise level increases. Therefore, it is preferable that the blower be operated in areas where the fan characteristic graph shows a downward line.

However, in a vehicle air conditioner, a plurality of flow passages is switched in use, with resistance in the flow passage varying over a wide range. Therefore, the blower still needs to be operated in an area that is not a downward trend in the fan characteristic graph.

In consideration of the above circumstances, an object of the present invention is to provide a centrifugal blower with reduced noise.

In order to solve the above problems, the present invention provides the following means.

Specifically, a first aspect of the present invention provides a centrifugal blower having: an impeller; a casing that houses the impeller and forms a spiral flow passage that surrounds a radial direction outside of the impeller; and a driving device that rotates the impeller about an axis, wherein the impeller has: a disk shaped bottom plate that is rotated about the axis by the driving device; a plurality of blades provided so as to project in the axial direction on a same circumference of the bottom plate; and a substantially annular plate shape shroud that has the blades interposed between it and the bottom plate, and that is disposed concentric with the bottom plate, and that connects end sections of the respective blades, the shroud has: an inclined section that comes closer to the bottom plate moving from a radial direction inside to a radial direction outside; and a shroud side barrier that rises from a position on the radial direction outside of the inclined section towards a side opposite to the bottom plate, and the casing has: a bell-mouth that opposes an area on a radial direction inside of an inner periphery of the shroud; and a casing side barrier that projects from a position on the radial direction outside of the bell-mouth to an area between the inner periphery of the shroud and the shroud side barrier.

In the centrifugal blower constructed as described above, the shroud has the inclined section and the shroud side barrier, and the casing has the bell-mouth and the casing side barrier, so that the gap formed between the casing and the shroud is of an intricately inflected labyrinth form passing from the radial direction outside of the shroud toward the radial direction inside. As a result, a flow resistance (pressure loss) in this gap is large, and backflow from this gap is effectively prevented.

Numbers of the shroud side barriers and the casing side barriers to be installed are arbitrary. The shroud side barrier and the casing side barrier may be provided alternately in the radial direction of the shroud, for example, a second shroud side barrier may be provided on the radial direction side of a first shroud side barrier and a second casing side barrier may be provided between the first shroud side barrier and the second shroud side barrier. In this case, the shape of the gap formed between the casing and the shroud becomes more complex and the flow resistance further increases, and backflow prevention effects can be enhanced as a result.

Here, in the centrifugal blower, as described above, a fan characteristic graph shows a horizontal or upward line in a small airflow area. Therefore, if the centrifugal blower is operated in this area, the impeller stalls and airflow within the centrifugal blower becomes unstable, and a backflow occurs in the area in the vicinity of the start point of the spiral flow passage at an entry of the bell-mouth, resulting in an increase in noise.

Therefore, the centrifugal blower of the first aspect mentioned above may be constructed so that the casing has a wind shielding plate that rises from an area in the vicinity of a start point of the spiral flow passage of the bell-mouth toward the outside of the casing.

In this case, the wind shielding wall provided in the area in the vicinity of the start point of the spiral flow passage of the bell-mouth blocks the backflow in the area in the vicinity of the start point of the spiral flow passage, and the intake flow is partially made to take a detour and is guided from other sections into the bell-mouth. Therefore, airflow within the centrifugal blower even in the small airflow area becomes stable, the fan characteristic graph shows a sufficient downward inclination, and noise level is reduced.

In order to reduce production cost by reducing the number of components of the centrifugal blower, it is preferable that the wind shielding wall be an integrated part of the bell-mouth.

Furthermore, a second aspect of the present invention provides a centrifugal blower having: an impeller; a casing that houses the impeller and forms a spiral flow passage that surrounds a radial direction outside of the impeller; and a driving device that rotates the impeller about an axis, wherein the impeller has: a disk shaped bottom plate that is rotated about the axis by the driving device; a plurality of blades provided so as to project in the axial direction on the same circumference of the bottom plate; and a substantially annular plate shape shroud that has the blades interposed between it and the bottom plate, and that is disposed concentric with the bottom plate, and that connects end sections of the respective blades, and the casing has: a bell-mouth that opposes an area on the radial direction inside of an inner periphery of the shroud; and a wind shielding plate that rises from an area in the vicinity of a start point of the spiral flow passage of the bell-mouth toward the outside of the casing.

In the centrifugal blower, as described above, a fan characteristic curve shows a horizontal or upward line in a small airflow area. Therefore, if the centrifugal blower is operated in this area, the impeller stalls and airflow within the centrifugal blower becomes unstable, and a backflow occurs in the area in the vicinity of the start point of the spiral flow passage at an entry of the bell-mouth, resulting in an increase in noise.

Therefore, as seen in the above second aspect of the present invention, by providing the wind shielding wall in the area in the vicinity of the start point of the spiral flow passage of the bell-mouth, backflow in this area can be blocked while intake flow can be partially detoured and guided from other sections into the bell-mouth. As a result, airflow within the centrifugal blower even in the small airflow area becomes stable, the fan characteristic curve shows a sufficient downward inclination, and noise level is reduced.

In order to reduce production cost by reducing the number of components of the centrifugal blower, it is preferable that the wind shielding wall be an integrated part of the bell-mouth.

Furthermore, a third aspect of the present invention provides a centrifugal blower having: an impeller; a casing that houses the impeller and forms a spiral flow passage that surrounds a radial direction outside of the impeller; and a driving device that rotates the impeller about an axis, wherein the impeller has: a disk shaped bottom plate that is rotated about the axis by the driving device; a plurality of blades provided so as to project in the axial direction on a same circumference of the bottom plate; and a substantially annular plate shape shroud that has the blades interposed between it and the bottom plate, and that is disposed concentric with the bottom plate, and that connects end sections of the respective blades, and the casing has: a bell-mouth that opposes an area on the radial direction inside of an inner periphery of the shroud; and a backflow suppressing wall that projects from the radial direction outside of the bell-mouth towards the bottom plate, and that surrounds the radial direction outside of the shroud.

In the centrifugal blower constructed in this way, in the casing there is provided the backflow suppressing wall that surrounds the radial direction outside of the shroud, and the airflow that has been fed into the casing by the impeller and that flows along a casing inner wall and returns to the vicinity of the shroud is interrupted by this backflow suppressing wall and diffused in the circumferential direction of the impeller, so that backflow from a gap formed between the casing and the shroud is effectively prevented.

The height of the backflow suppressing wall is arbitrary. However, in order not to reduce the efficiency of the centrifugal blower, in the area of the spiral flow passage where air supply pressure from the impeller is sufficiently higher than the internal pressure of the spiral flow passage (an area other than in the vicinity of the nose section), it is preferable that the height of the backflow suppressing wall be made to a height that does not interrupt the main flow of the airflow that the impeller generates, for example, a height whereby a tip end of the barrier reaches an imaginary line formed by extending the sectional shape of the shroud in the radial direction, or a height equal to that of the outer periphery of the shroud.

Moreover, in the centrifugal blower having the casing side barrier and the shroud side barrier, or the centrifugal blower having the wind shielding wall, the casing may have a backflow suppressing wall that projects from the radial direction outside of the bell-mouth toward the bottom plate, and that surrounds the radial direction outside of the shroud.

In the centrifugal blower constructed in this way, the airflow that has been fed into the casing by the impeller and that returns along the casing inner wall to the vicinity of the shroud is interrupted by the backflow suppressing wall and diffused in the circumferential direction of the impeller. As a result, backflow from the gap formed between the casing and shroud can be effectively prevented.

Furthermore, the backflow suppressing wall may be such that a portion in the vicinity of a nose section, which makes a border portion between a start point of the spiral flow passage and a portion a full circle therefrom, is a projecting section that projects toward the bottom plate side to a greater degree compared to other portions.

Here, as described above, in the portion in the vicinity of the nose section of the spiral flow passage, supplied pressure of the air from the impeller is close to or less than the internal pressure of the spiral flow passage. Therefore, in the vicinity of the nose section, backflow from inside of the spiral flow passage passing between the blades of the impeller toward the impeller is likely to occur.

Therefore, as described above, by making the portion of the backflow suppressing wall in the vicinity of the nose section, a projecting section that projects to the bottom plate side more than other portions, backflow in this portion passing between the blades can be effectively prevented.

In the centrifugal blower of the respective aspects mentioned above, in the spiral flow passage, a secondary flow suppressing vane that separates part of a space within the spiral flow passage into a side close to the impeller and a side distanced from the impeller may be provided along the spiral flow passage. Here "secondary flow" refers to a flow that passes across the spiral flow passage within the spiral flow passage.

In the centrifugal blower constructed in this way, the airflow that has been fed from the impeller into the spiral flow passage is separated by the secondary flow suppressing vane into an airflow that flows on the side close to the impeller and an airflow that flows on the side distanced from the impeller. As a result, a secondary flow is unlikely to pass to the impeller, and the secondary flow is unlikely to interfere with the impeller, resulting in noise reduction.

Moreover, in the centrifugal blower provided with a projecting section for a backflow suppressing wall as described above, in the spiral flow passage, a secondary flow suppressing vane that separates a part of a space within the spiral flow passage into a side close to the impeller and a side distanced from the impeller may be provided from a position in the projecting section of the backflow suppressing wall, on the upstream side of a rising section on the immediate upstream side of the nose section, to at least the nose section along the spiral flow passage.

The secondary flow and backflow occur in the position in the spiral flow passage distanced from the impeller, and are made to flow by the airflow within the spiral flow passage to reach the impeller in the vicinity of the nose section.

Therefore, as described above, the secondary flow suppressing vane which is in the position distanced further from the impeller than the backflow suppressing wall, is provided from the position in the projecting section of the backflow suppressing wall further on the upstream side than the rising section on the immediate upstream side of the nose section, to at least the nose section along the spiral flow passage. As a result, the secondary flow and backflow can be effectively diffused at the stage where they occur, and noise due to interference of the secondary flow and backflow with the impeller can be reduced.

Furthermore, a fourth aspect of the present invention provides a centrifugal blower having: an impeller; a casing that houses the impeller and forms a spiral flow passage that surrounds a radial direction outside of the impeller; and a driving device that rotates the impeller about an axis, wherein the impeller has: a disk shaped bottom plate that is rotated about the axis by the driving device; a plurality of blades provided so as to project in the axial direction on a same circumference of the bottom plate; and a substantially annular plate shape shroud that has the blades interposed between it and the bottom plate, and that is disposed concentric with the bottom plate and that connects end sections of the respective blades, the casing has: a bell-mouth that opposes an area on the radial direction inside of an inner periphery of the shroud, and the shroud has a shape that inclines with respect to the axis so as to come close to the bottom plate when moving from the radial direction inside toward the radial direction outside, and in an area on the radial direction outside of the shroud, a plane that faces the radial direction inside is an inclined plane that inclines at a predetermined angle with respect to the axis, and in an area on the radial direction inside of the shroud, a plane that faces the radial direction inside has: a first convex curved plane that gradually projects from an inner periphery of the shroud toward the radial direction inside; and a second convex curved plane that smoothly connects the first convex curved plane and the inclined plane.

In the centrifugal blower constructed in this way, in the area on the radial direction inside of the shroud, on the plane that faces the radial direction inside, there is provided the first convex curved plane that gradually projects from the inner periphery of the shroud toward the radial direction inside. As a result, a gap between the shroud and bell-mouth becomes narrower with approach from a base side of the bell-mouth to the tip end side.

Therefore, the air that has flowed back from the spiral flow passage into the gap between the shroud of the impeller and an inner plane of the casing is constricted and straightened when it passes through the gap between the shroud and the bell-mouth. Therefore, disturbance in the airflow is reduced. As a result, the airflow is released to the blades in a state in which disturbance in the airflow has been reduced, and hence noise can be reduced.

Furthermore, in the area on the radial direction outside of the shroud, the plane that faces the radial direction inside is an inclined plane that inclines with respect to the axis at a predetermined angle. Therefore, among the air that is fed into the spiral flow passage by the impeller, the air flowing in the vicinity of the shroud is smoothly guided along the shroud without departing from the plane that faces the radial direction inside of the shroud. As a result, disturbance is unlikely to occur in the air that flows in the vicinity of the shroud, and the noise is reduced.

Furthermore, the first convex curved plane and the inclined plane are smoothly connected by the second convex curved plane, so that the air that has flowed back from between the shroud and the bell-mouth is smoothly guided to the inclined plane, and noise is reduced.

According to the centrifugal blower according to the present invention, since backflow is prevented, noise is significantly reduced compared to the conventional centrifugal blower and it is unlikely to cause discomfort to a user, while operation can be carried out stably to perform excellent blowing.

DETAILED DESCRIPTION OF THE INVENTION

Hereinafter, embodiments of the present invention are described, with reference to the drawings.

First Embodiment

Figure 1:
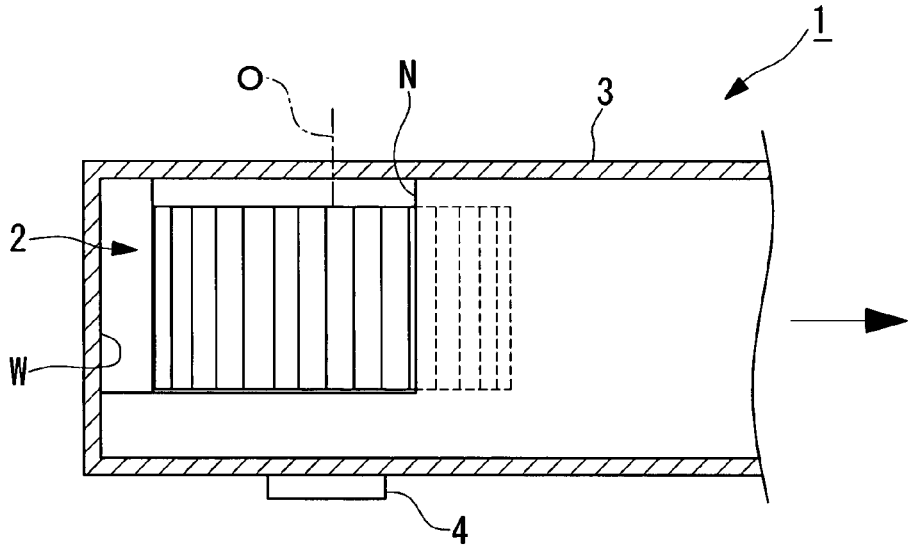
FIG. 1 is a longitudinal sectional view showing a construction of a centrifugal blower according to a first embodiment of the present invention.

A first embodiment of the present invention is described below, with reference to FIG. 1 through FIG. 3.

A centrifugal blower 1 according to the present embodiment is used as a blower of a vehicle air conditioner.

This centrifugal blower 1 has an impeller 2, a casing 3 that houses the impeller 2 and forms a spiral flow passage W surrounding the radial direction outside of the impeller 2, and a driving device 4 that rotates the impeller 2 about an axis O.

Here, although not shown in the drawing, provided on a downstream side of the spiral flow passage W of the centrifugal blower 1, are each of the flow passages (face side flow passage, foot side flow passage, defrost side flow passage, and so forth) of, a vehicle air conditioner and a device (heat exchanger for cooling, heater core, and so forth) that conditions the air that has been fed into the spiral flow passage W. At an entry of each of the flow passages there is provided a damper, the opening and closing of which are controlled by a control device, opening and closing of the damper being controlled according to an operation mode of the vehicle air conditioner to feed the air that has been force-fed into the spiral flow passage, into an appropriate flow passage.

Figure 3:
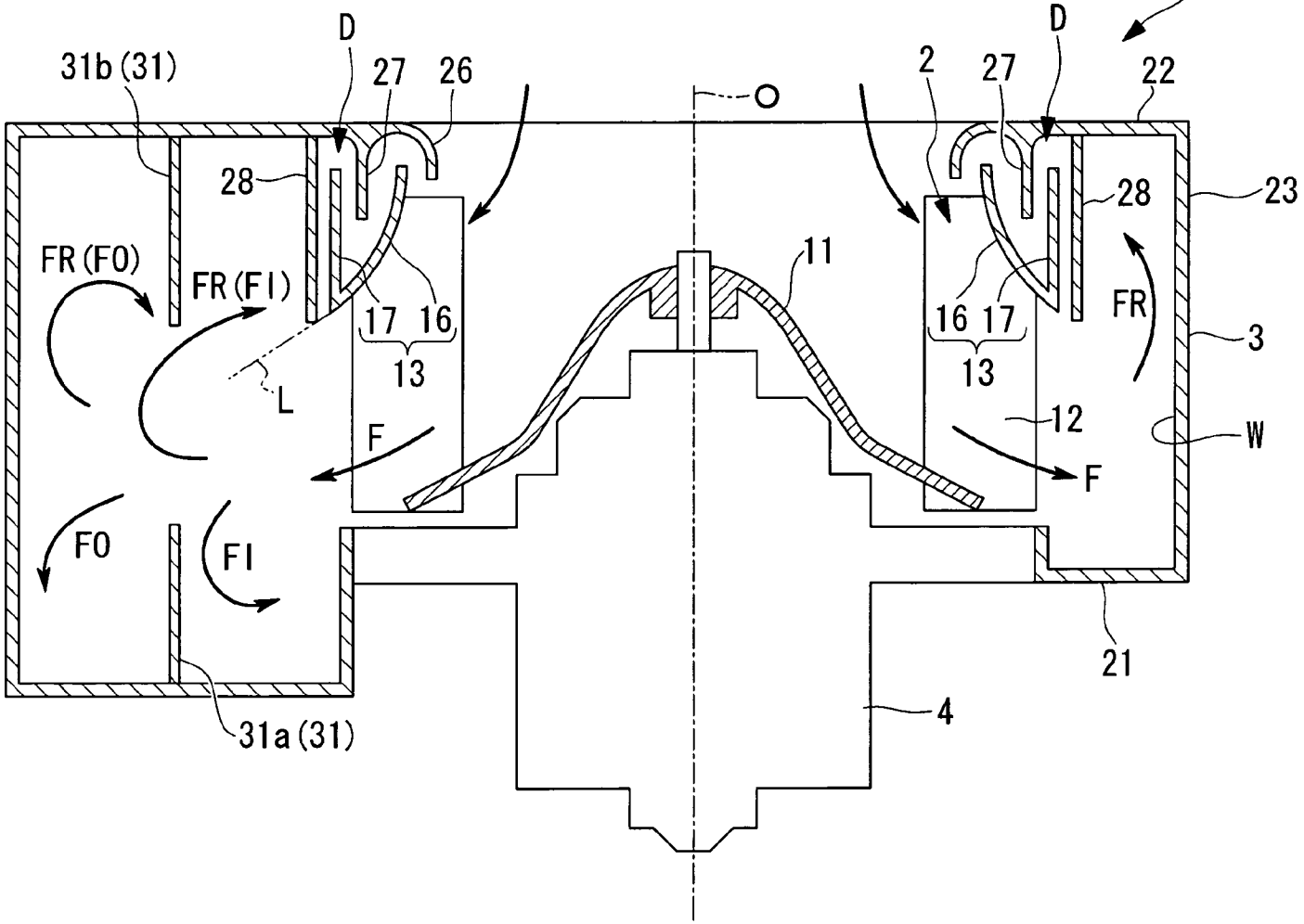
FIG. 3 is a longitudinal sectional view showing the construction of the centrifugal blower according to the first embodiment of the present invention.

As shown in FIG. 3, the impeller 2 has: a substantially disk shaped bottom plate 11 that is rotated about the axis O by the driving device 4; a plurality of blades 12 provided so as to be positioned on the opposite surface to the driving device 4 side of the bottom plate 11 on the same circumference; and a substantially ring plate shaped shroud 13 that is disposed with these blades 12 interposed between it and the bottom plate 11 and concentric with the bottom plate 11, and that joins the end sections of the respective blades 12.

The impeller 2 is rotated about the axis O by the driving device 4, thereby taking in air from the side where the shroud 13 is disposed to the radial direction inside of the blades 12, the blades 12 giving this air a centrifugal force to force feed it into the spiral flow passage W that surrounds the circumference of the impeller 2.

In the present embodiment, the bottom plate 11 is bent so that the center section thereof is positioned further to the shroud 13 side than the periphery section, so that a housing space is formed on the surface side opposing the driving device 4. This housing space houses one part of the driving device 4, and thereby, a size reduction in the axis O direction in the centrifugal blower 1 is achieved.

Moreover, the bottom plate 11, from the center section thereof to the periphery thereof, forms a smooth curved surface having a depression toward the shroud 13 side. Thus, the air that has been taken in from the shroud 13 side to the radial direction inside of the blades 12 is guided along the bottom plate 11 to the radial direction outside and is smoothly supplied to the blades 12.

The blade 12 is a plate shaped member that stands up from the bottom plate 11 parallel to the axis O, and a sectional surface thereof that is orthogonal to the axis O has a substantially arc shape. These blades 12 are respectively disposed around the axis O at equal intervals.

The shroud 13 has: an incline section 16 that comes closer to the bottom plate 11 moving from the radial direction inside to the radial direction outside; and a shroud side barrier 17 of a substantially cylindrical shape that stands up in a direction away from the bottom plate 11 in a position to the radial direction outside of the incline section 16.

In the present embodiment, the incline section 16 refers is an area from the inner periphery to the vicinity of the outer periphery of the shroud 13. Moreover, the incline section 16, when seen from the bottom plate 11 side, forms a trumpet shaped curved surface, the diameter of which increases as it gets closer to the bottom plate 11. Thus, the air that has been taken in through the shroud 13 to the radial direction inside of the blades 12 is guided along the shroud 13 to the radial direction outside and it is smoothly supplied to the blades 12.

Furthermore, the shroud side barrier 17 is substantially concentric with the axis O and stands up from the outer periphery of the incline section 16, and the incline section 16 and the shroud side barrier 17 intersect with each other at an acute angle.

The casing 3 has a bottom plate 21 that opposes the bottom plate 11 side of the impeller 2, an top plate 22 that opposes the shroud 13 side of the impeller 2, and a side wall 23 that connects these bottom plate 21 and top plate 22. The space surrounded by these bottom plate 21, top plate 22 and side wall 23 forms the spiral flow passage W, the cross section of which is of a substantially quadrangle shape. Hereinafter, in the centrifugal blower 1 the bottom plate 21 side refers to downward and the top plate 22 side refers to upward.

In the top plate 22, there is provided: a bell-mouth 26 that opposes the area to the radial direction inside of the inner periphery of the shroud 13; and a casing side barrier 27 that projects from a position to the radial direction outside of the bell-mouth 26 into an area between the inner periphery of the incline section 16 and the shroud side barrier 17.

The bell-mouth 26 is in a ring plate shape having a smooth curved surface that comes closer to the bottom plate 21 side toward the radial direction inside. The casing side barrier 27 has a substantially cylindrical shape disposed substantially concentric with the axis O.

The incline section 16, the shroud side barrier 17, the bell-mouth 26, and the casing side barrier 27 form a gap D, which is intricately inflected at a steep angle on a sectional plane along the radial direction of the impeller 2, between the top plate 22 and the shroud 13.

In the casing 3, there is provided a backflow suppressing wall 28 that projects from the radial direction outside of the bell-mouth 26 toward the bottom plate 11 so as to surround the radial direction outside of the shroud 13.

This backflow suppressing wall 28, is disposed substantially concentric with the axis O, having a substantially cylindrical shape, the height around the entire circumference of which is equal, and is provided in extremely close proximity to the shroud 13. The height of this backflow suppressing wall 28 is preferably a height that, in areas other than the area in the vicinity of a nose section N described later, does not interrupt the area through which the main airflow generated by the impeller 2 passes, so as not to reduce the efficiency of the centrifugal blower 1, for example, a height where a tip end of the backflow suppressing wall 28 reaches an imaginary line L extended in the radial direction outside from the radial direction incline section 16 of the shroud 13, or a height equal to that of the outer periphery of the shroud 13. In the present embodiment, the backflow suppressing wall 28 is of a height such that the tip end thereof reaches the imaginary line L.

Moreover, on at least one of either the bottom plate 21 and the top plate 22, there is provided a secondary flow suppressing vane 31 along the spiral flow passage W, for separating one portion of the space of the spiral flow passage W into a side in the vicinity of the impeller 2 and a side distanced from the impeller 2. However, in order to more efficiently suppress secondary flow, the secondary flow suppressing vane 31 may be provided along the spiral flow passage W from both of the bottom plate 21 and the top plate 2 sides.

In the present embodiment, in the bottom plate 21, there is provided a lower side secondary flow suppressing vane 31*a* in a radial direction intermediate position of the spiral passage W, while on the top plate 22, there is provided an upper side secondary flow suppressing vane 31*b* in a radial direction intermediate position of the spiral flow passage W.

The heights of these upper and lower secondary flow suppressing vanes 31*a* and 31*b* are preferably heights that do not interrupt the area through which airflow generated by the impeller 2 passes, so as not to reduce the efficiency of the centrifugal blower 1. However, in the vicinity of the nose section N where a pressure difference in the radial direction is large and backflow to the impeller 2 is likely to occur, the upper and lower secondary flow suppressing vanes 31*a* and 31*b* may be respectively extended in the axial direction so that they maintain high static pressure on the vane outer diameter side and low static pressure on the vane inner diameter, so as to prevent backflow to the impeller 2.

In the centrifugal blower 1 constructed as described, the gap D formed between the casing 3 and the shroud 13 has an intricately inflected labyrinth shape that passes from the radial direction outside of the shroud 13 to the radial direction inside. Furthermore, this gap D has an acute angled inflection portion. As a result, the flow resistance (pressure loss) in this gap D is large, and backflow from this gap D is effectively prevented. By preventing backflow in this way, noise is significantly reduced compared to a conventional centrifugal blower and it is unlikely to cause discomfort to a user, while operation can be carried out stably to perform excellent blowing.

Moreover, the airflow F generated by the impeller 2 makes contact with the side wall 23 within the spiral flow passage W, and then passes along this side wall 23 around to the bottom plate 21 side and the top plate 22 side. Among these airflows, an airflow FR that has come around to the top plate 22 side proceeds along the top plate 22 toward the radial direction inside of the spiral flow passage W, that is, toward the gap D. However, since the backflow suppressing wall 28 that surrounds the radial direction outside of the shroud 13 is provided in the casing 3, and the airflow FR is interrupted by the backflow suppressing wall 28 and diffused in the circumferential direction of the impeller 2, backflow from the gap D is effectively prevented.

Figure 2:
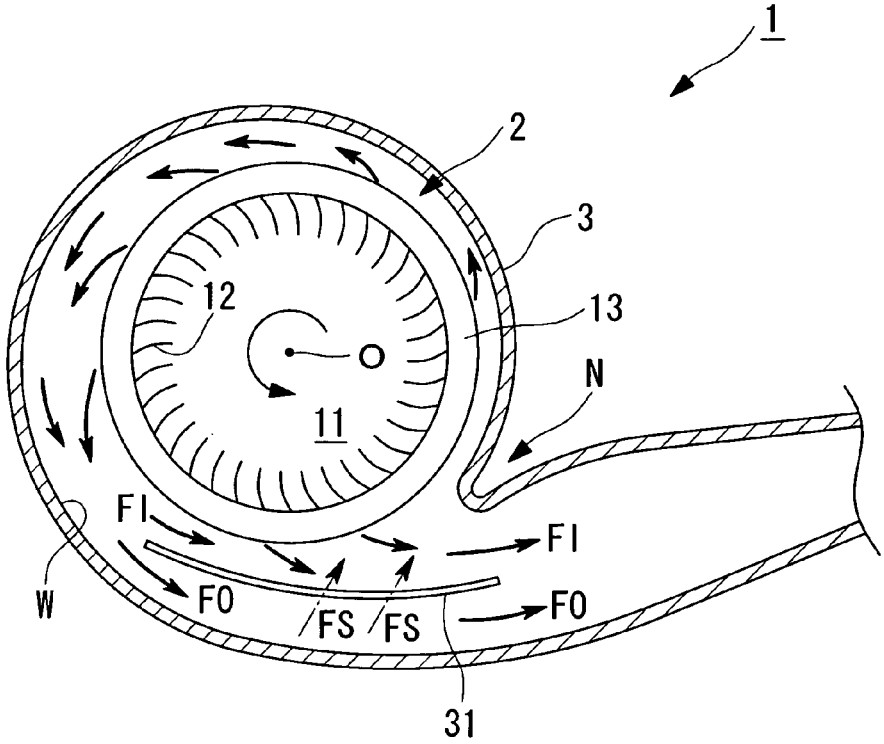
FIG. 2 is a plane sectional view showing the construction of the centrifugal blower according to the first embodiment of the present invention.

Moreover, in this centrifugal blower 1, as shown in FIG. 2, the secondary flow suppressing vane 31 is provided inside the spiral flow passage W so that the airflow that has been fed into the spiral flow passage W is separated by this secondary flow suppressing vane 31 into an airflow FI that flows on the side close to the impeller 2 and an airflow FO that flows on the side distanced from the impeller 2, and the airflow flows within the spiral flow passage W in this way. As a result, a secondary flow that crosses the spiral flow passage W is unlikely to occur within the spiral flow passage W, and interference between the secondary flow and the impeller 2 becomes unlikely to occur, resulting in a reduction in noise. Here, for reference, in FIG. 2, secondary flow that occurs in a conventional centrifugal blower is shown with imaginary lines FS.

Moreover, by suppressing the secondary flow in this way, interference with the impeller 2 is reduced and noise can be reduced.

Here, in the above embodiment, an example of respectively providing one each of the shroud side barrier 17 and the casing side barrier 27 is shown. However, the number of them to be provided is arbitrary. The shroud side barrier 17 and the casing side barrier 27 may be provided alternately in the radial direction of the shroud 13. For example, a second shroud side barrier may be provided to the radial direction outside of a first shroud side barrier, and a second casing side barrier may be provided between the first shroud side barrier and the second shroud side barrier. In this case, the shape of the gap D formed between the casing 3 and the shroud 13 becomes more complex and the flow resistance further increases, enabling the backflow prevention effect to be enhanced.

Moreover, as described above, in the area in the vicinity of the nose section N (refer to FIG. 2), which is a border section between a start point of the spiral flow passage W and a portion a full circle from this start point, the air supply pressure from the impeller 2 is close to or less than the internal pressure of the spiral flow passage W. Therefore, in the vicinity of the nose section N, backflow from the inside of the spiral flow passage W passing between the blades 12 of the impeller 2 toward the inside of the impeller 2 is likely to occur.

Figure 4:
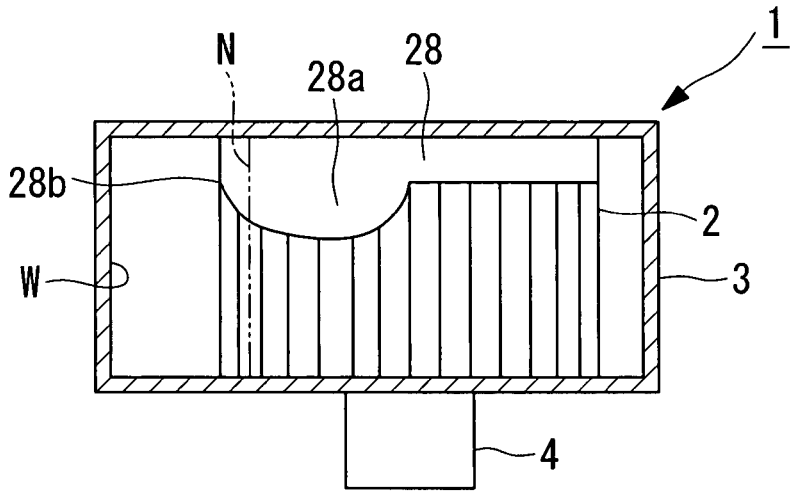
FIG. 4 is a drawing showing another example of the centrifugal blower according to the first embodiment of the present invention.

Therefore, as shown in FIG. 4, in the backflow suppressing wall 28, by providing in the area in the vicinity of the nose section N a projecting section 28*a* that projects toward the bottom plate 11 side to a greater degree compared to other portions, backflow passing between the blades 12 in this portion can be effectively prevented.

Moreover, the secondary flow and backflow occur in a position in the spiral flow passage W distanced from the impeller 2, and they are made to flow by airflow within the spiral flow passage W, thereby reaching the impeller 2 in the vicinity of the nose section N.

Figure 5:
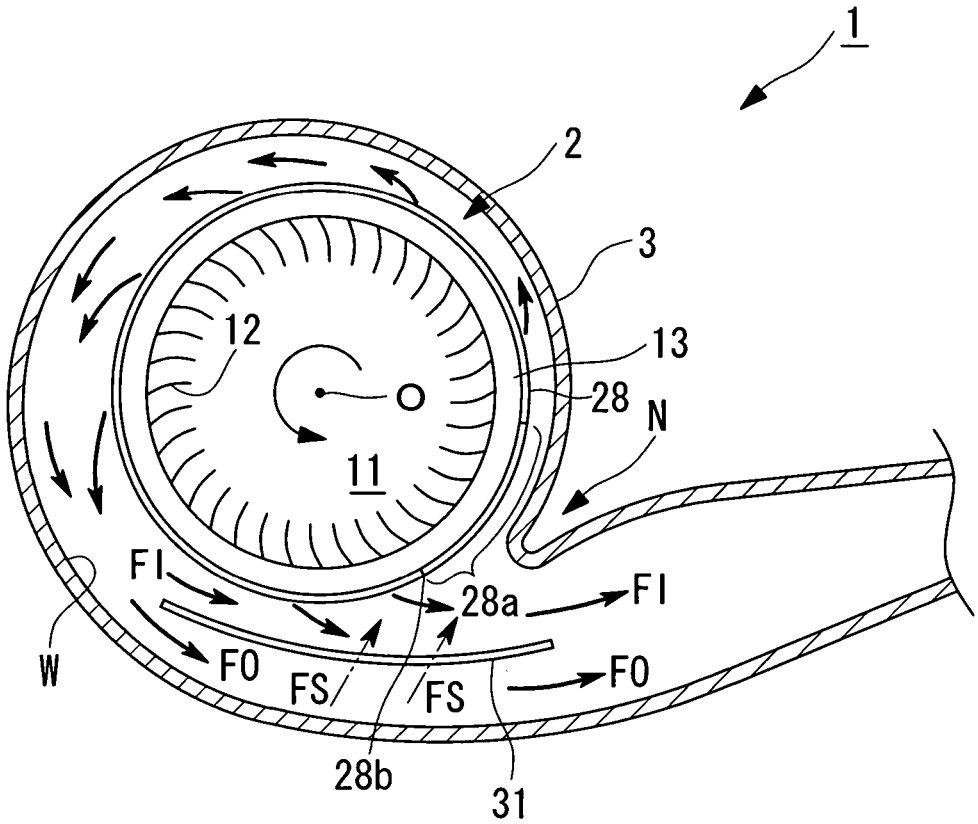
FIG. 5 is a drawing showing another example of the centrifugal blower according to the first embodiment of the present invention.

Therefore, as shown in FIG. 5, by providing the secondary flow suppressing vane 31 which is in a position further distant from the impeller 2 than the backflow suppressing wall 28, so as to extend from a position in the projecting section 28*a* of the backflow suppressing wall 28 further on the upstream side than a rising section 28*b* on the immediate upstream side of the nose section N to at least the nose section N along the spiral flow passage W, secondary flow and backflow can be effectively diffused in the stage where they are generated, and noise associated with interference of secondary flow and backflow with the impeller 2 can be reduced.

Second Embodiment

A second embodiment of the present invention is described below, with reference to FIG. 6 through FIG. 8.

A centrifugal blower 51 according to the present embodiment is characterized mainly in that in the centrifugal blower 1 described in the first embodiment, the casing 3 has a wind shielding plate 52 that rises from the area in the vicinity of a start point S of the spiral flow passage W of the bell-mouth 26 toward the outside of the casing 3.

Hereinafter, structures similar to or the same as those in the centrifugal blower 1 described in the first embodiment are denoted by the same reference symbols, and their detailed description is omitted.

Figure 6:
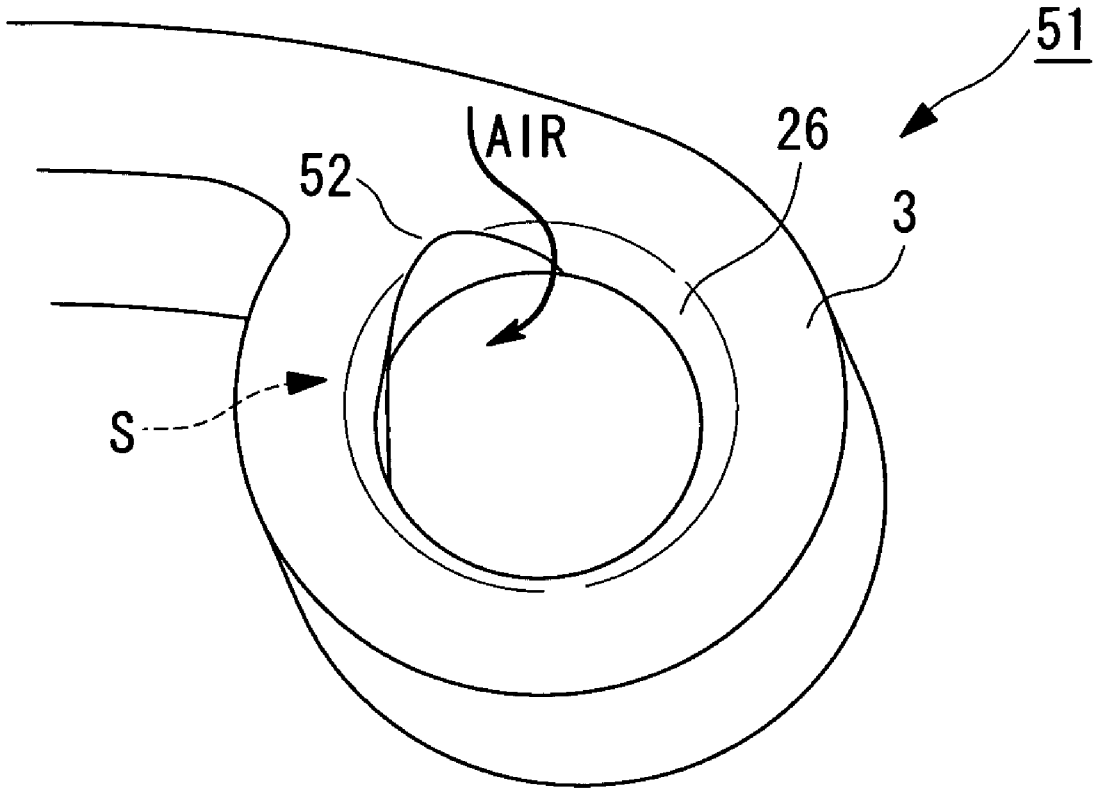
FIG. 6 is a perspective view showing a construction of a centrifugal blower according to a second embodiment of the present invention.
Figure 7A:
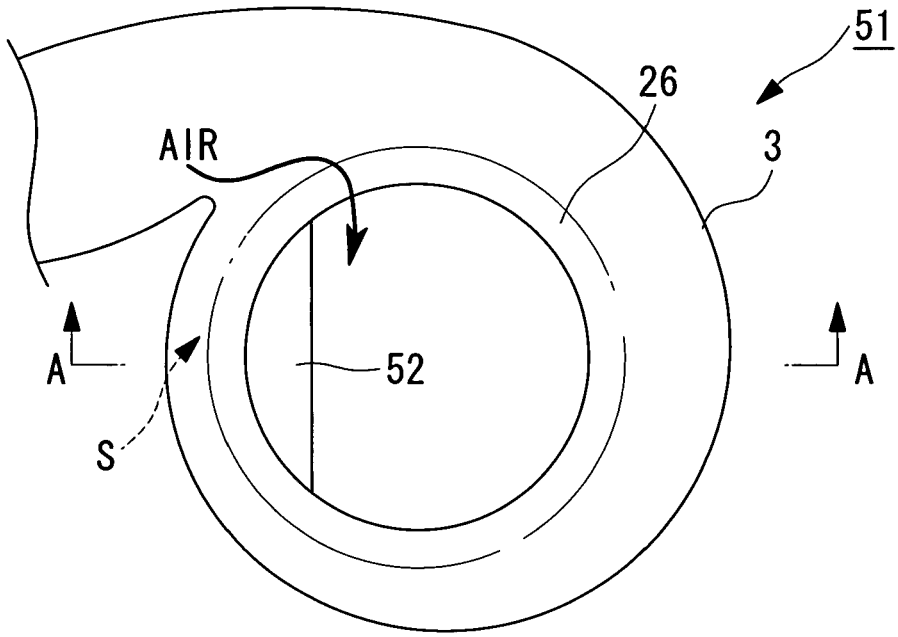
FIG. 7 is a drawing showing the construction of the centrifugal blower according to the second embodiment of the present invention, FIG. 7A being a plan view, and FIG. 7B being a perspective sectional view of FIG. 7A taken along the line A-A.
Figure 7B:
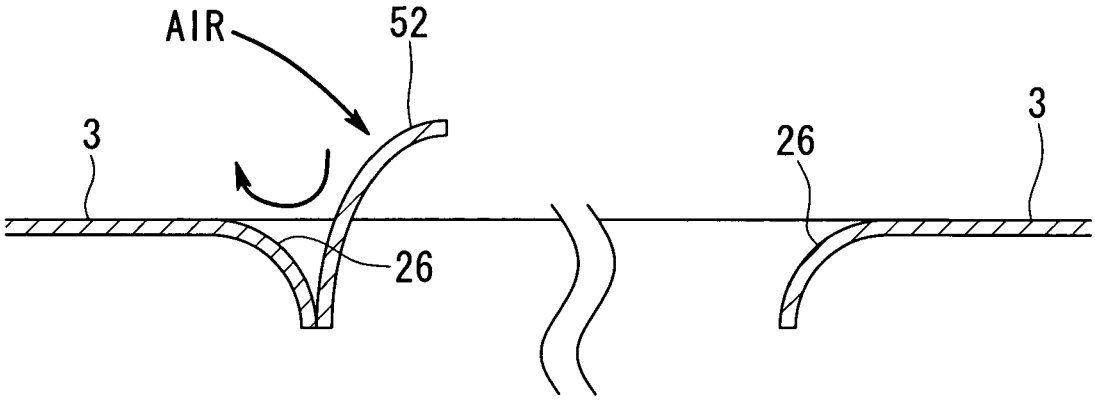
Figure 8:
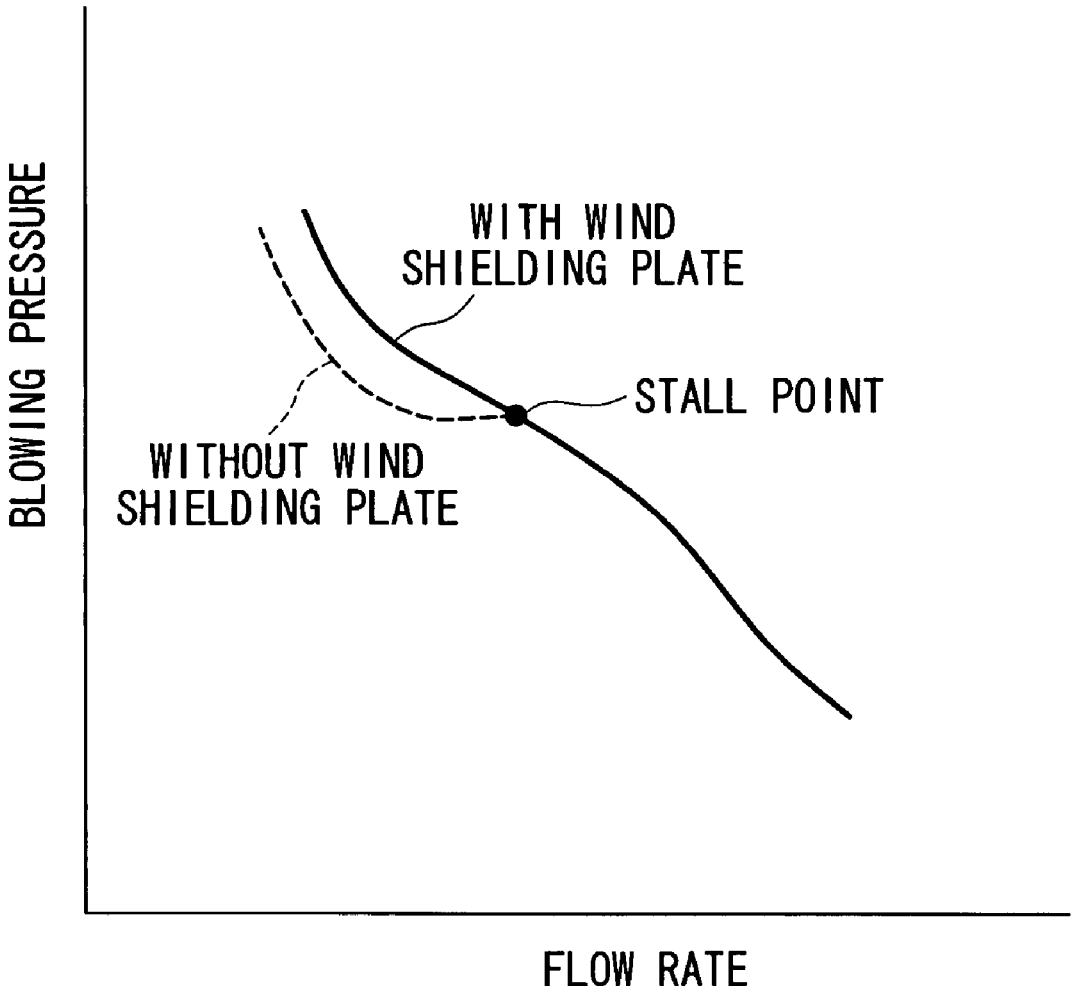
FIG. 8 is a graph of the characteristic of a fan of the centrifugal blower according to the second embodiment of the present invention.

As shown in FIG. 6, FIG. 7A and FIG. 7B, the wind shielding plate 52 is provided so as to overhang above the casing 3 along the inner periphery of the bell-mouth 26, and is formed in a curved surface having a convex shape toward the radial direction outside.

Moreover, as shown in FIG. 7A, the wind shielding plate 52 overhangs above the bell-mouth 26 also, so as to cover above the area in the vicinity of the start point S of the spiral flow passage W in the bell-mouth 26.

In the present embodiment, since the wind shielding plate 52 is a component integrated with the bell-mouth 26 and the number of components of the centrifugal blower 51 is equal to that of the centrifugal blower 1, an increase in production cost can be suppressed.

In the conventional centrifugal blower, as described above, a fan characteristic graph shows a horizontal or upward line in the small airflow area. Therefore, if the centrifugal blower is operated in this area, the impeller stalls and airflow within the centrifugal blower becomes unstable, and a backflow occurs in the area in the vicinity of the start point of the spiral flow passage at an entry of the bell-mouth, resulting in an increase in noise.

In the centrifugal blower 51 according to the present embodiment, the wind shielding wall 52 provided in the area in the vicinity of the start point of the spiral flow passage W of the bell-mouth 26 blocks backflow in the area in the vicinity of the start point of the spiral flow passage, and an intake flow of AIR is partially made to take a detour and is guided from other sections into the bell-mouth 26. As a result, the airflow within the centrifugal blower 51 is stabilized in the small airflow area also, and the fan characteristic graph shows an improvement compared to the state before the wind shielding plate 52 was installed (the portion shown with a broken line in FIG. 8), and, as shown in FIG. 8 with a solid line, a sufficient downward inclination is observed even in the area where there was conventionally a stall point, resulting in a reduction in noise.

Third Embodiment

Figure 9:
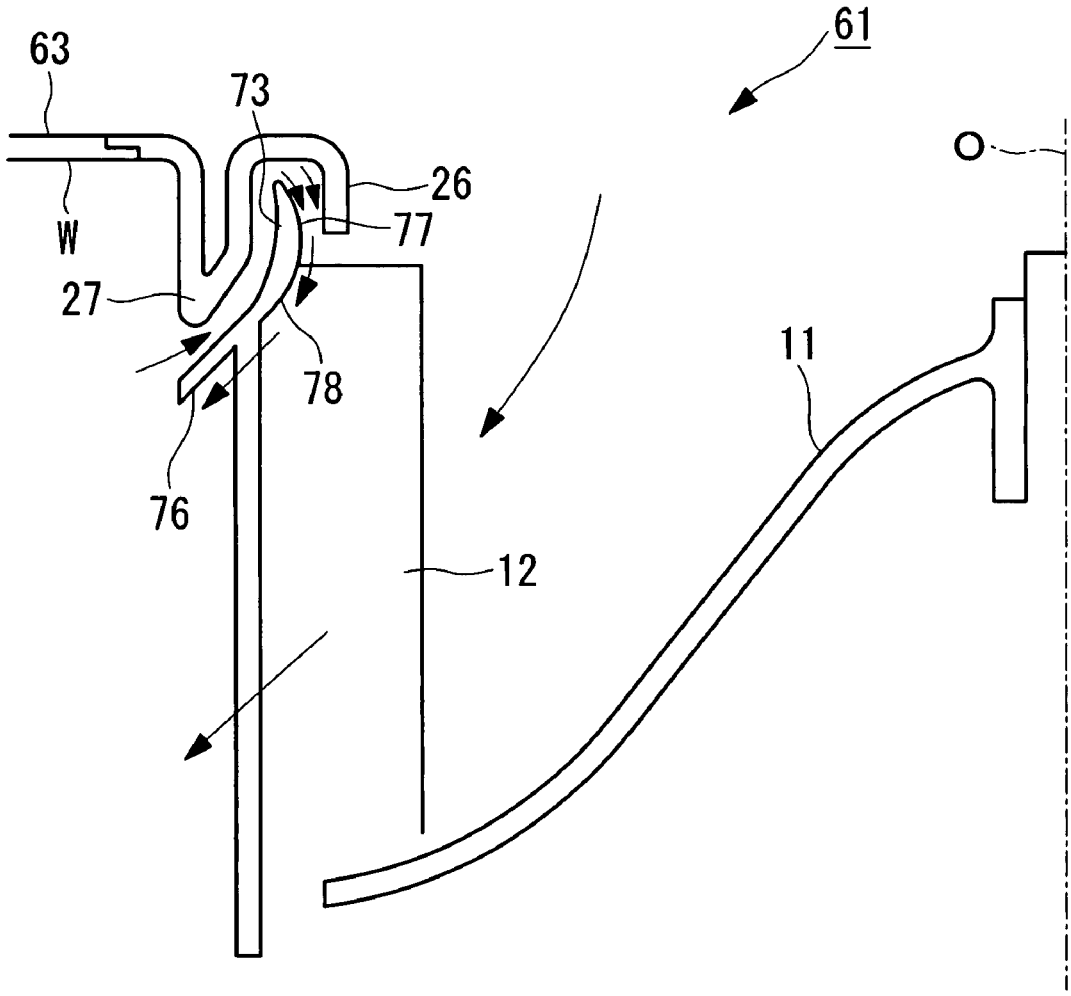
FIG. 9 is a longitudinal sectional view showing a construction of a centrifugal blower according to a third embodiment of the present invention.

A third embodiment of the present invention is described below, with reference to FIG. 9.

A centrifugal blower 61 of the present embodiment uses a casing 63 in the centrifugal blower 1 shown in the first embodiment instead of the casing 3, and it uses a shroud 73 instead of the shroud 13. Hereinafter, structures similar to or the same as those in the centrifugal blower 1 described in the first embodiment are denoted by the same reference symbols, and their detailed description is omitted.

The casing 63, is the casing 3 with the backflow suppressing wall 28 removed.

Moreover, in the casing 63, the casing side barrier 27 is provided so as to oppose a plane that faces the radial direction outside of the shroud 73. In the present embodiment, in the top plate section 22 of the casing 63, an area that opposes a plane that faces the radial direction outside of the shroud 73 is inflected along the plane that faces the radial direction outside of the shroud 73, and this inflected section forms the casing side barrier 27.

Here, the casing 63 may be manufactured as an entirely integrated component. In this case, the number of components for the casing 63 can be made few, and production cost can be kept low. Moreover, in the case where the casing 63 is manufactured by a manufacturing method that uses molding dies such as an injection die, by making the entire casing 63 an integrated component in this way, the number of molding dies to be used can be made few, and production cost can be kept low.

Conversely, a casing main body may be created as a separate member from the area in the vicinity of the bell-mouth 26 including the inflected section. In this case, since the shape of only one of either the casing main body or the area in the vicinity of the bell-mouth 26 can be easily changed, even in the case where load characteristic of the centrifugal blower 61 changes due to changes in the specification or operating conditions, the shape of either the casing main body or the bell-mouth 26 can be changed into an appropriate shape according to the changes in the load characteristic, so that changes in the load characteristic of the centrifugal blower 61 can be easily addressed.

The shroud 73 has a shape that inclines with respect to the axis O, becoming closer to the bottom plate 11 while moving from the radial direction inside to the radial direction outside.

Furthermore, in the area on the radial direction outside of the shroud 73, the plane that faces the radial direction inside is an inclined plane 76 that inclines with respect to the axis O at a predetermined angle.

In the area on the radial direction inside of the shroud 73, the plane that faces the radial direction inside is constructed with a first convex curved plane 77 that gradually projects from the inner periphery of the shroud 73 toward the radial direction inside, and a second convex curved plane 78 that smoothly connects between the first convex curved plane 77 and the inclined plane 76.

In the centrifugal blower 61 constructed in this way, in the area on the radial direction inside of the shroud 73, on the plane that faces the radial direction inside, there is provided the first convex curved plane 77 that gradually projects from the inner periphery of the shroud 73 toward the radial direction inside, and a gap between the shroud 73 and the bell-mouth 26 becomes narrower with approach from a base side of the bell-mouth 26 to the tip end side.

As a result, the air that has flowed back from the spiral flow passage W into the gap between the shroud 73 of the impeller 2 and an inner plane of the casing 63 is constricted when it passes through the gap between the shroud 73 and the bell-mouth 26, raising its flow speed.

Therefore, the air that has flowed back from the spiral flow passage W into the gap between the shroud 73 of the impeller 2 and the inner plane of the casing 63 is constricted and straightened when it passes through the gap between the shroud 73 and the bell-mouth 26, and hence disturbance in the airflow is reduced.

As a result, the airflow is released to the blades 12 in a state in which disturbance in the airflow has been reduced, and hence noise can be reduced.

Furthermore, in the area on the radial direction outside of the shroud 73, the plane that faces the radial direction inside is an inclined plane that inclines with respect to the axis O at a predetermined angle. Therefore, among the air that is fed into the spiral flow passage W by the impeller 2, the air flowing in the vicinity of the shroud 73 is smoothly guided along the shroud 73 without departing from the plane that faces the radial direction inside of the shroud 73, so that disturbance is unlikely to occur in the air that flows in the vicinity of the shroud 73, and the noise is reduced.

Furthermore, the first convex curved plane 77 and the inclined plane 76 are smoothly connected by the second convex curved plane 78, so that the air that has flowed back from between the shroud 73 and the bell-mouth 26 is smoothly guided to the inclined plane 76, and noise is reduced.

Here, in the present embodiment, the construction of the casing 63 does not have the backflow suppressing wall 28. However, it is not limited to this, and the backflow suppressing wall 28 may be provided in the casing 63.

Furthermore, the shroud 73 described in the present embodiment may be employed in the centrifugal blower described in the second embodiment.

The invention claimed is:

1. A centrifugal blower, comprising:

an impeller;

a casing that houses said impeller and forms a spiral flow passage that surrounds a circumference of said impeller; and a driving device that rotates said impeller about an axis, wherein said impeller has: a disk shaped bottom plate that is rotated about said axis by said driving device;

a plurality of blades provided so as to project in said axial direction on a same circumference of said bottom plate; and a substantially annular plate shape shroud that has said blades interposed between it and said bottom plate, and that is disposed concentric with said bottom plate, and that connects end sections of the respective blades, said shroud has: an inclined section in which radially the more outside a portion thereof is, the closer the portion is to said bottom plate; and a shroud side barrier provided in a radially outer side of said inclined section to extend away from said bottom plate, said casing has: a bell-mouth that opposes an inner circumference of said shroud; and a casing side barrier provided on a radially outer side of said bell-mouth to extend into a gap between said inclined section and said shroud side barrier, and the inclined section, the shroud side barrier, the bell-mouth and the casing side barrier overlap with each other in a radial direction, wherein said casing has a wind shielding plate provided on a part of said bell-mouth in the vicinity of a start point of said spiral flow passage to rise radially inward and away from said bottom plate.

2. A centrifugal blower, comprising:

an impeller;

a casing that houses said impeller and forms a spiral flow passage that surrounds a circumference of said impeller; and a driving device that rotates said impeller about an axis, wherein said impeller has: a disk shaped bottom plate that is rotated about said axis by said driving device;

a plurality of blades provided so as to project in said axial direction on the same circumference of said bottom plate; and a substantially annular plate shape shroud that has said blades interposed between it and said bottom plate, and that is disposed concentric with said bottom plate, and that connects end sections of the respective blades, and said casing has: a bell-mouth that opposes an inner circumference of said shroud; and a wind shielding plate provided on a part of said bell-mouth in the vicinity of a start point of said spiral flow passage to rise radially inward and away from said bottom plate.

3. A centrifugal blower, comprising:

an impeller;

a casing that houses said impeller and forms a spiral flow passage that surrounds a circumference of said impeller; and a driving device that rotates said impeller about an axis, wherein said impeller has: a disk shaped bottom plate that is rotated about said axis by said driving device;

a plurality of blades provided so as to project in said axial direction on a same circumference of said bottom plate; and a substantially annular plate shape shroud that has said blades interposed between it and said bottom plate, and that is disposed concentric with said bottom plate, and that connects end sections of the respective blades, and said casing has: a bell-mouth that opposes an inner circumference of said shroud; and a backflow suppressing wall provided on a radially outer side of said bell-mouth to project toward said bottom plate and to surround a circumference of said shroud, the backflow suppressing wall having such a height that a tip of a brim of said backflow suppressing wall is on an imaginary extended plane of said inner circumference of said shroud, or is aligned with an outer periphery of said inner circumference of said shroud, wherein said backflow suppressing wall is such that a portion in the vicinity of a nose section, which makes a border portion between a start point of said spiral flow passage and a portion a full circle therefrom, is a projecting section that projects toward said bottom plate side to a greater degree compared to other portions.

4. A centrifugal blower according to claim 3, wherein in said spiral flow passage, a secondary flow suppressing vane that separates a part of a space within said spiral flow passage into a side close to said impeller and a side distanced from said impeller is provided from a position in said projecting section of said backflow suppressing wall, on the upstream side of a rising section on the immediate upstream side of said nose section, to at least the nose section along the spiral flow passage.

5. A centrifugal blower, comprising:

an impeller;

a casing that houses said impeller and forms a spiral flow passage that surrounds a circumference of said impeller; and a driving device that rotates said impeller about an axis, wherein said impeller has: a disk shaped bottom plate that is rotated about said axis by said driving device;

a plurality of blades provided so as to project in said axial direction on a same circumference of said bottom plate; and a substantially annular plate shape shroud that has said blades interposed between it and said bottom plate, and that is disposed concentric with said bottom plate and that connects end sections of the respective blades, said casing has: a bell-mouth that opposes an inner circumference of said shroud, said shroud has a shape that inclines with respect to said axis in which radially the more outside a portion thereof is, the closer the portion is to said bottom plate, an inner circumference of a radially outer portion of said shroud is an inclined plane that inclines at a predetermined angle with respect to said axis, an inner circumference of a radially inner portion of said shroud has: a first convex curved plane that includes a brim of said shroud, in which the closer a portion thereof is to said bottom plate, the closer the portion is to said bell-mouth so as to make a gap between said radially inner portion and said bell-mouth, measured in a direction perpendicular to a median line of said gap, gradually narrower; and a second convex curved plane that smoothly connects said first convex curved plane and said inclined plane, and a width of said gap measured at the brim of said shroud and a width of said gap measured at a brim of said bell-mouth are smaller than a width of said gap measured at a point between the brim of said shroud and the brim of said bell-mouth.

6. A centrifugal blower according to claim 2, wherein said casing has a backflow suppressing wall that projects from the radial direction outside of said bell-mouth toward said bottom plate, and that surrounds the radial direction outside of said shroud.

7. A centrifugal blower, comprising:

an impeller;

a casing that houses said impeller and forms a spiral flow passage that surrounds a circumference of said impeller; and a driving device that rotates said impeller about an axis, wherein said impeller has: a disk shaped bottom plate that is rotated about said axis by said driving device;

a plurality of blades provided so as to project in said axial direction on a same circumferences of said bottom plate; and a substantially annular plate shape shroud that has said blades interposed between it and said bottom plate, and that is disposed concentric with said bottom plate, and that connects end sections of the respective blades, said shroud has: am inclined section in which radially the more outside a portion thereof is, the closer the portion is to said bottom plate; and a shroud side barrier provided on a radially outer side of said inclined section to extend away from said bottom plate, said casing has: a bell-mouth that opposes an inner circumference of said shroud; and a casing side barrier provided on a radially outer side of said bell-mouth and the casing side barrier overlap with each other in a radial direction, wherein said casing has a backflow suppressing wall provided on a radially outer side of said bell-mouth to project toward said bottom plate and to surround a circumference of said shroud, the backflow suppressing wall having such a height that a tip of a brim of said backflow suppressing wall is on an imaginary extended plane of said inner circumference of said shroud, or is aligned with an outer periphery of said inner circumference of said shroud, and wherein said backflow suppressing wall is such that a portion in the vicinity of a nose section, which makes a border portion between a start point of said spiral flow passage and a portion a full circle therefrom, is a projecting section that projects toward said bottom plate side to a greater degree compared to other portions.

8. A centrifugal blower according to claim 6, wherein said backflow suppressing wall is such that a portion in the vicinity of a nose section, which makes a border portion between a start point of said spiral flow passage and a portion a full circle therefrom, is a projecting section that projects toward said bottom plate side to a greater degree compared to other portions.

9. A centrifugal blower according to claim 2, wherein in said spiral flow passage, a secondary flow suppressing vane that separates part of a space within said spiral flow passage into a side close to said impeller and a side distanced from said impeller is provided along said spiral flow passage.

10. A centrifugal blower according to claim 7, wherein in said spiral flow passage, a secondary flow suppressing vane that separates a part of a space within said spiral flow passage into a side close to said impeller and a side distanced from said impeller is provided from a position in said projecting section of said backflow suppressing wall, on the upstream side of a rising section on the immediate upstream side of said nose section, to at least the nose section along the spiral flow passage.

11. A centrifugal blower according to claim 8, wherein in said spiral flow passage, a secondary flow suppressing vane that separates a part of a space within said spiral flow passage into a side close to said impeller and a side distanced from said impeller is provided from a position in said projecting section of said backflow suppressing wall, on the upstream side of a rising section on the immediate upstream side of said nose section, to at least the nose section along the spiral flow passage.

* * * * *